US005410814A

United States Patent [19]

Caban

[11] Patent Number: 5,410,814

[45] Date of Patent: May 2, 1995

[54] BABY BOTTLE NIPPLE OPENER

[76] Inventor: Francis A. Caban, 2727 W. Dr. M. L. King, Jr. Blvd., Suite 620, Tampa, Fla. 33607

[21] Appl. No.: 123,158

[22] Filed: Sep. 7, 1993

[51] Int. Cl.[6] ..... B26F 1/00

[52] U.S. Cl. ..... 30/368; 30/162; 30/335

[58] Field of Search ..... 30/162, 163, 329, 335, 30/336, 340, 296.1, 298, 164.5, 164.7, 164.9, 368

[56] References Cited

U.S. PATENT DOCUMENTS 845,792 3/1907 Jenkins ..... 30/162
2,848,809 8/1958 Crowder ..... 30/162 X
3,885,308 5/1975 Gordin ..... 30/162
4,601,710 7/1986 Moll ..... 30/162 X

*Primary Examiner*—Douglas D. Watts
*Attorney, Agent, or Firm*—Rogers & Killeen

[57] ABSTRACT

A device for making, or enlarging, an opening in the tip of a rubber baby bottle nipple. One embodiment of the device has a lancet which can be selectively extended from a housing to cut an opening in the tip of a nipple. Alternatively, the lancet may be fixedly extended a predetermined distance from the housing and the nipple pushed onto the exposed end of the lancet by compression of a hinged, U-shaped handle. Other embodiments of the invention comprise a freestanding structure having the shape of a baby bottle nipple with a blade either mounted in a socket attached thereto on a flexible arm or string or in the structure itself.

20 Claims, 4 Drawing Sheets

BABY BOTTLE NIPPLE OPENER

BACKGROUND OF THE INVENTION

The present invention relates to devices that can be used to make an opening in a baby bottle nipple where there is none, or to enlarge or reopen an opening that already exists that may have been fused closed.

With reference to FIGS. 1 and 2, baby bottles 10 are typically provided with a nipple 22 that may be removed for cleaning or replacement. Baby bottle nipples are available in a variety of shapes and sizes (two are shown in FIGS. 1 and 2) and are made of rubber or rubber-like material that is flexible and easily penetrated by a reasonably sharp object. Each baby bottle nipple 12 is provided with an opening 14 at its tip so that liquid may be suckled therefrom. The opening 14 desirably has a size sufficient to allow liquid to be removed by suction, but not so large that liquid will flow out of the opening without the suction. The opening 14 may take various shapes, with X-shaped (including openings formed by any number of overlapping slices in the nipple material) and circular (including nearly circular, such as ovate) being the most common. X-shaped openings are typically used in nipples such as shown in FIG. 1 having a hemispheric shape, and circular openings are typically used in nipples such as shown in FIG. 2 having a cylindrical shape, although the present invention is not limited to these nipple types and openings.

As is known, the opening 14 may become clogged or fused closed, or simply may be too small to allow proper suction. Heretofore, innovative parents have used various implements to reopen or unclog a closed opening. However, there has been no means available to reliably and safely control the size of the opening so made. For example, the end of a paring knife may be used to open a clogged opening, but the user is unable to control the depth of penetration of the knife into the tip of the nipple to control opening size. As may well be imagined, attempts to control the depth of penetration with the fingers may cause injury and are not recommended. Further, the use of implements that do not conformably hold the nipple may cause the nipple material to stretch during penetration, thereby reducing the accuracy of the size of the opening provided.

Various types of penetration devices are known, but none have been adapted to the purpose of the present invention, and known devices do not provide a safe and reliable means for making an opening of controllable size in the tip of a baby bottle nipple. For example, trocars and devices for piercing holes in ear lobes project a lancet or punch from a housing. They do not include means for controlling opening size and are not able to conformably receive a baby bottle nipple so that an opening of accurate size may be provided.

Accordingly, it is an object of the present invention to provide a novel device for making an opening in the tip of a baby bottle nipple that obviates the problems of the prior art and is safe and reliable to use.

It is another object of the present invention to provide a novel device for making an opening in the tip of baby bottle nipple that includes a housing that is shaped to conformably receive a nipple.

It is yet another object of the present invention to provide a novel device for making an opening in the tip of baby bottle nipple that includes a blade for piercing the nipple material that is extended a predetermined distance so that the size of the opening may be controlled.

It is still another object of the present invention to provide a novel device for making an opening in the tip of baby bottle nipple that includes a blade that is extended in preset intervals with a press-to-extend or twist-to-extend mechanism.

It is a further object of the present invention to provide a novel device for making an opening in the tip of baby bottle nipple that includes a handle that is U-shaped and adapted to operate with a single hand and in which the end of the blade is safely concealed.

It is still a further object of the present invention to provide a novel device for making an opening in the tip of a baby bottle nipple that includes a freestanding structure conformably shaped to receive a baby bottle nipple and having a cutting blade attached thereto on the end of a flexible arm.

It is yet still further an object of the present invention to provide a novel device for making an opening in the tip of a baby bottle nipple that includes a freestanding structure where the cutting blade is attached to the structure and projects upwardly from it.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
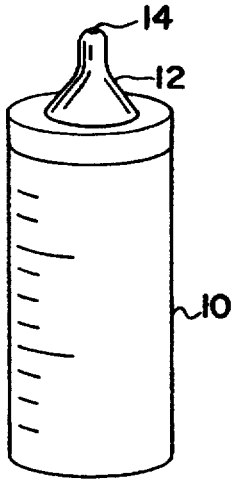
FIG. 1 PRIOR ART
FIG. 1 is baby bottle and nipple of the prior art.
Figure 2:
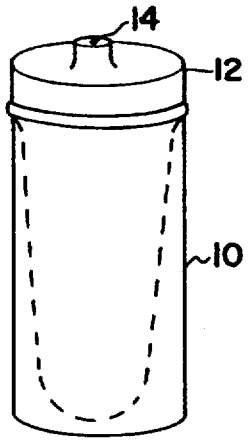
FIG. 2 PRIOR ART
FIG. 2 is another baby bottle and nipple of the prior art.
Figure 3:
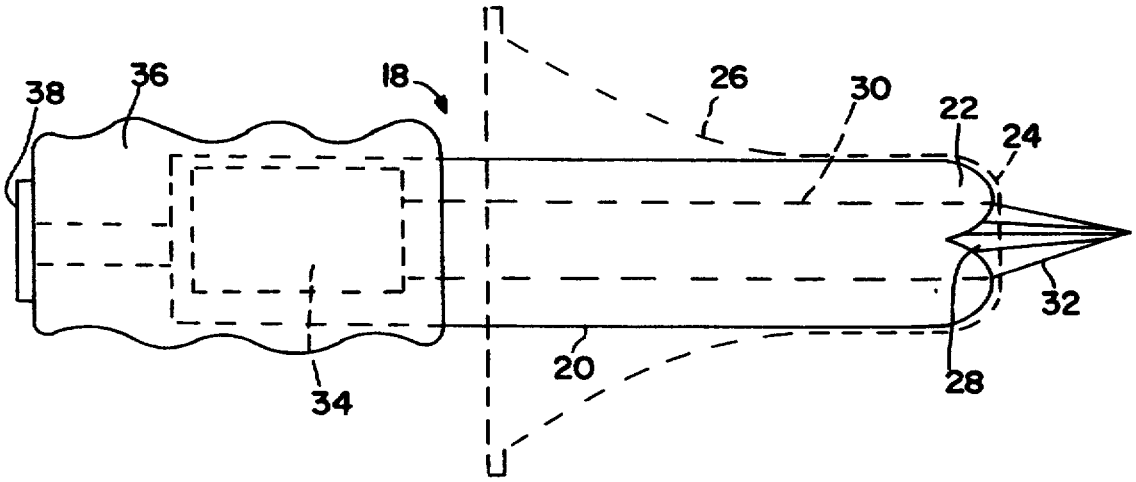
FIG. 3 is a pictorial view of an embodiment of the present invention.

With reference now to FIG. 3, a device 18 of the present invention may include a tubular housing 20 having an end 22 shaped to conform to the interior of the tip 24 of a baby bottle nipple 26, the end 22 having an opening 28 therein. A sliding member 30, such as a lancet, is carried inside housing 20 so that it may move longitudinally therethrough. The sliding member 30 includes a blade 32 or similar projection for piercing the tip 24 of the nipple 26. As will be discussed in more detail below, an extension mechanism 34 is provided for controlling the distance that the blade 32 is extended from the opening 28, and a handle 36 may be provided for grasping the device 18. An operating mechanism 38 is also provided so that the extension mechanism 34 may be operated while the device 18 is being held in one hand.

The device 18 is operated by placing a nipple 26 onto the housing 20 so that the interior of the nipple tip 24 conforms to the exterior of end 22. Thereafter, the handle 36 is gripped and the extension mechanism 34 operated to extend the blade 32 through the nipple material a desired distance to form an opening of desired size in the tip 24. The nipple 26 may be held in the position shown in FIG. 3 while the blade is being extended, or the nipple 26 may be pressed onto the end 22 with the blade 32 already extended.

The extension mechanism 34 may be carried inside the housing 20 and include a conventional press-to-extend or twist-to-extend feature, such as found in some mechanical/drafting pencils. When an end (such as end 38 in FIG. 3) is pressed or twisted, the part of the device at the opposite end of the housing is extended a preset or determinable distance, thereby allowing the extension of the blade, and thus the size of the opening in the tip 24, to be controlled.

Figure 4:
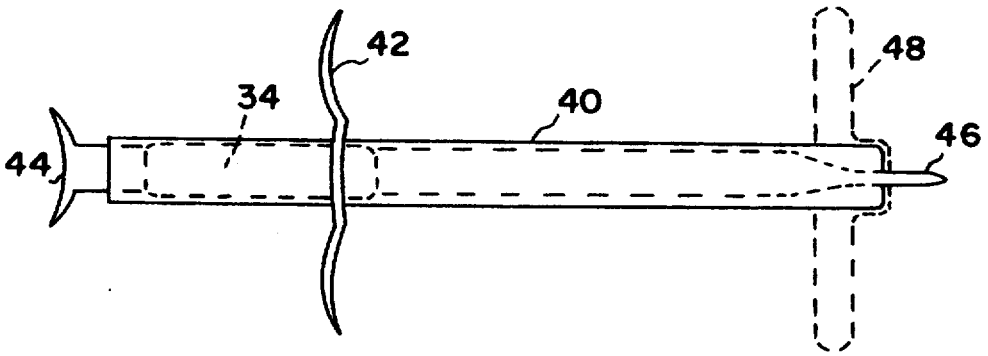
FIG. 4 is a pictorial view of a further embodiment of the present invention illustrating a hand operated press-to-extend or twist-to-extend mechanism.

The press-to-extend extension mechanism may find application in other embodiments of the present invention, such as the one illustrated in FIG. 4. As seen therein, housing 40 and finger grips 42 are arranged so that the extension mechanism 34 may be operated by thumb pad 44. Each press on thumb pad 44 extends blade 46 a preset distance so that penetration of nipple 48 is made to an appropriate depth.

Figure 5:
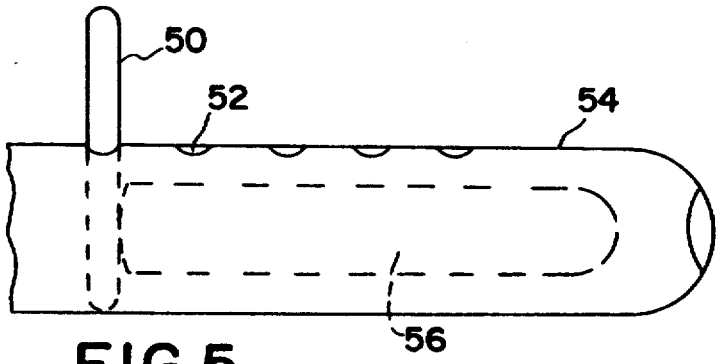
FIG. 5 is a pictorial view of a further embodiment of the present invention.
Figure 6:
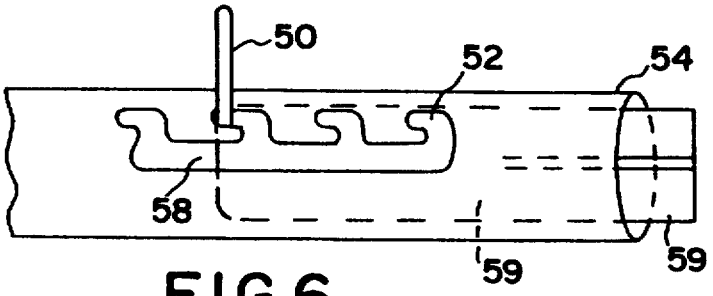
FIG. 6 is a pictorial view of an embodiment of the present invention with a slide for selectably extending the blade.

With reference now to FIG. 5, a further embodiment of the present invention may include an extension mechanism 34 with a movable stopper 50 that is placed in one of several openings 52 in the side of housing 54. The stopper 50 extends across the interior of the housing to prevent further retraction of the sliding member 56. As illustrated in FIG. 6, the stopper 50 may be attached to the sliding member 56 and the openings 52 connected with a slot 58 so that the sliding member 56 may be moved longitudinally through the housing 54 and set in an opening to hold the sliding member at a predetermined location.

Figure 7:
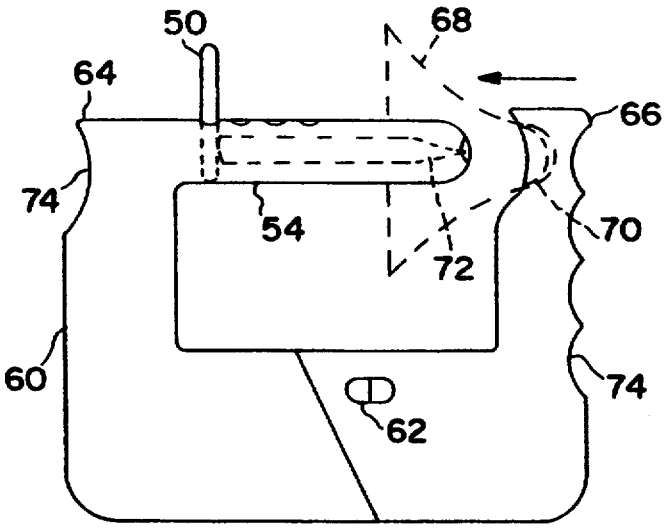
FIG. 7 is a pictorial view of a further embodiment of the present invention illustrating a U-shaped handle.

With reference now to FIG. 7, an alternative embodiment of the present invention may include a U-shaped handle 60 with a hinge 62 between opposing ends 64 and 66 of the handle. A housing for receiving the nipple 68 (such as housing 20 in FIG. 3 or housing 54 in FIGS. 5 and 6) is mounted on one end 64 of the handle to partially span the opening between the ends 64 and 66. The other end 66 of the handle 60 has a recess 70 therein that corresponds to the end of the housing 20, 54. Operation of the hinge 62 allows the housing to move into the recess 70 when the ends are pressed together so that the blade 72 may pierce the nipple in the recess. The recess 70 may have an extension to receive the blade 72. The stopper 50 that moves the blade may be moved set to a predetermined position before or after the ends of the handle have been pressed together. The blade 72 is shielded by the handle so that the opportunity for inadvertent injury is reduced. Thumb and finger pads 74 may be provided for convenience. In a further alternative embodiment, the recession 70 may be replaced by a strike plate.

Figure 8:
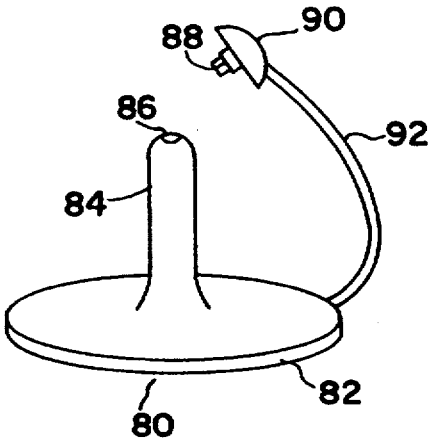
FIG. 8 is a pictorial view of a further embodiment of the present invention illustrating a freestanding structure for receiving a baby bottle nipple and a blade holder attached thereto.
Figure 9:
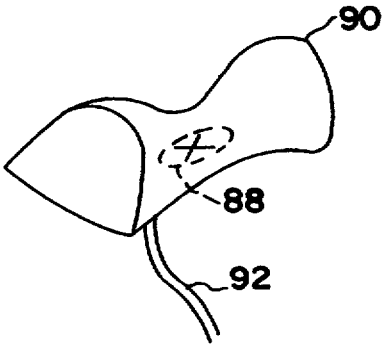
FIG. 9 is a further view of the blade holding socket of the embodiment of FIG. 8.

As illustrated in FIG. 8, another embodiment of the present invention may include a freestanding structure 80 supported by a base 82. A housing 84 projecting upwardly from the base 82 has the shape and dimensions to receive a baby bottle nipple thereon. The housing 84 contains a recess 86 to receive a blade 88 mounted in a socket 90 that is attached to the base 82 with an appropriate attachment 92, such as a string or flexible plastic arm. As seen in FIG. 9, the socket 90 may be shaped to be held between the thumb and forefinger and may be saddle-backed so that it may be easily manipulated. When a nipple is draped over the housing 84, the socket 90 is moved into position over the tip of the nipple and pushed down so that the blade 88 seats in the recess 86 to puncture the nipple.

Figure 10:
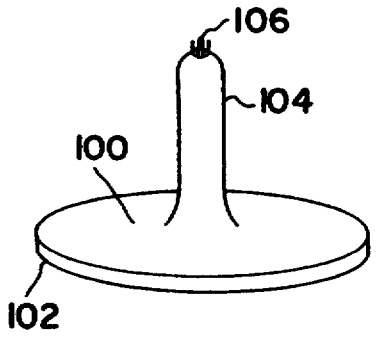
FIG. 10 is a pictorial view of an additional embodiment of the present invention illustrating a freestanding structure for receiving a baby bottle nipple having a blade mounted in the freestanding structure and projecting upwardly from it.

With reference to FIG. 10, another embodiment of the present invention may include a freestanding structure 100 supported by a base 102. A housing 104 projecting upwardly from the base 102 is conformally shaped so that a baby bottle nipple may be placed over it. At the end of the upwardly projecting housing 104 a blade 106 is mounted so that it extends upwardly from the housing 104. When a baby bottle nipple is placed over the housing and pulled downwardly so that it is taut with respect to the end of the housing 104 the blade 106 cuts an opening in the nipple.

As illustrated herein, the blade that pierces the nipple may have several embodiments. For example, it may be pointed with an "X" cross section (FIG. 3), pointed with a circular cross section (FIG. 4), blunt with a circular cross section (FIG. 5 or blunt with an "X" cross section (FIG. 6). The opening through which the blade extends may have a conforming shape.

As will be apparent to those skilled in the art, the features of the invention described herein are not limited to the specific embodiments with which they are associated in the drawings. Further, while preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A hand-operated device for making an opening of a predetermined size in a tip of a baby bottle nipple, the device comprising:

a generally tubular housing having a first end with a first opening therein, said first end having a hemispheric shape corresponding to the interior of a baby bottle nipple so that a baby bottle nipple may be conformably placed on said housing first end with a tip of the baby bottle nipple covering said first opening;

a lancet carried within said housing and having a first end that may be moved along a longitudinal axis of said housing and extended through said first opening, said lancet first end having a blade for piercing a baby bottle nipple;

engaging means in said housing for controlling movement of said lancet through said housing so that said blade may be extended a predetermined distance from said housing first end and so that the size of an opening made in a baby bottle nipple may be controlled; and grasping means attached to said housing for holding said device with one hand.

2. The device of claim 1 wherein said grasping means comprises a U-shaped handle with a hinge between ends thereof so that said handle ends may be pressed together, said housing being mounted on a first one of said handle ends so that when said handle ends are pressed together a second one of said handle ends approaches said housing first end to press a baby bottle nipple onto said housing first end and may have an opening made therein by said blade extended from said housing first end.

3. The device of claim 2 wherein said first handle end on which said housing is mounted has a pad upon which to rest a thumb and where said second handle end has pads upon which to rest fingers so that said device may be operated with one hand.

4. The device of claim 1 wherein said engaging means comprises a stopper selectively carried in one of plural openings in a side of said generally tubular housing, said stopper extending into said housing and preventing movement of said lancet in a direction toward a second end of said housing.

5. The device of claim 4 wherein each of said plural openings defines one said predetermined distance.

6. The device of claim 4 wherein said plural openings are connected by a slot so that said stopper can be moved without removal.

7. The device of claim 1 wherein said lancet blade has an X-shaped cross section.

8. The device of claim 1 wherein said lancet blade has a circular cross section.

9. The device of claim 1 wherein said lancet blade has an oval cutting edge and said housing first end is generally hemispherical.

10. The device of claim 1 wherein said lancet blade has a straight edge.

11. The device of claim 1 wherein said engaging means comprises a press-to-extend mechanism that selectively extends said blade a preset interval from said housing first end each time a second end of said lancet is pressed, whereby an opening is made in a baby bottle nipple placed on said housing first end when said blade is extended and the size of an opening made thereby is controlled by selected operation of said press-to-extend mechanism.

12. The device of claim 11 wherein said lancet second end comprises a portion that returns to the same position relative to said housing after each time said lancet second end is pressed.

13. The device of claim 11 wherein said press-to-extend mechanism comprises a pad adapted to receive a human thumb on said lancet second end.

14. The device of claim 1 wherein said grasping means comprises finger grips projecting laterally from said housing.

15. A device for providing an opening in a tip of a baby bottle nipple comprising:

a cylindrical housing having two ends, each with an opening therein, a first end of said cylindrical housing having a shape generally conforming to the interior of the tip of a baby bottle nipple;

sliding means carried within said cylindrical housing and able to move longitudinally therein;

a lancet connected to a first end of said sliding means said lancet being able to extend through the opening in said first end of said housing;

a press-to-extend mechanism at the second end of said housing for selectively controlling movement of said sliding means, said press-to-extend mechanism having a portion contacted by an operator of said device that returns to the same position relative to said housing after operation of said press-to-extend mechanism;

a pad suitable for a human thumb affixed to said press-to-extend mechanism; and a crossmember affixed externally to said cylindrical housing and projecting laterally therefrom, said crossmember having two pads, each suitable for a human finger, whereby a baby bottle nipple conformably placed onto said housing first end is pierced to provide an opening therein when said press-to-extend mechanism is operated to extend said lancet from said housing first end, and whereby the size of the opening so made may be controlled by selective operation of said press-to-extend mechanism.

16. The device of claim 15 wherein said lancet has an X-shaped cross section and said housing first end is generally hemispheric.

17. The device of claim 15 wherein said lancet has a circular cross section and said housing first end is generally cylindrical.

18. The device of claim 15 wherein said lancet has a straight edge.

19. The device of claim 15 wherein said first end is hemispheric.

20. The device of claim 15 wherein said first end is cylindrical.

* * * * *